United States Patent [19]

Carroll

[11] Patent Number: 4,874,210

[45] Date of Patent: Oct. 17, 1989

[54] PRODUCT DISPLAY AND DISPENSING UNIT

[75] Inventor: Francis A. Carroll, Sandymount, Ireland

[73] Assignee: Institute for Industrial Research and Standards, Dublin, Ireland

[21] Appl. No.: 68,195

[22] Filed: Jun. 30, 1987

[30] Foreign Application Priority Data

Jul. 2, 1986 [IE] Ireland ..... 1782/86
Dec. 30, 1986 [BE] Belgium ..... 0/217640

[51] Int. Cl.[4] ..... A47B 43/00

[52] U.S. Cl. ..... 312/257.1; 312/108; 312/121; 312/263

[58] Field of Search ..... 312/257 SK, 265, 263, 312/264, 118, 257 R, 257 SM, 108, 107, 257 A, 121, 124, 138 R, 140; 16/337, 86 R, 86 A, DIG. 17

[56] References Cited

U.S. PATENT DOCUMENTS

| | | | |
|---|---|---|---|
| 664,864 | 1/1901 | Hoult | 312/108 |
| 1,293,400 | 2/1919 | Fuller | 312/257 R |
| 1,471,197 | 10/1923 | Oxley | 312/257 R X |
| 1,701,806 | 2/1929 | Flanagan | 312/213 X |
| 1,848,214 | 3/1932 | Brown . | |
| 3,272,581 | 9/1966 | Stucki | 312/257 R X |
| 3,592,344 | 7/1971 | Schade | 312/108 X |
| 4,130,971 | 12/1978 | Herrig | 312/263 X |
| 4,311,100 | 1/1982 | Gardner et al. | 108/111 |
| 4,384,751 | 5/1983 | Guntermann et al. | 312/257 SK |
| 4,562,776 | 1/1986 | Miranda | 108/111 |
| 4,628,568 | 12/1986 | Lee et al. | 16/337 |

FOREIGN PATENT DOCUMENTS

| | | | |
|---|---|---|---|
| 2506616 | 8/1975 | Fed. Rep. of Germany | 312/257 R |
| 1226197 | 7/1960 | France | 312/108 |
| 359438 | 9/1970 | Sweden . | |
| 25968 | 6/1980 | Sweden . | |
| 30796 | 9/1982 | Sweden . | |
| 34014 | 2/1984 | Sweden . | |
| 850049 | 1/1985 | Sweden . | |
| 36695 | 6/1985 | Sweden . | |
| 86-1508 | 6/1986 | Sweden . | |
| 268467 | 8/1950 | Switzerland | 16/337 |
| 18794 | of 1911 | United Kingdom . | |
| 2081070 | 2/1982 | United Kingdom | 312/108 |

*Primary Examiner*—Peter A. Aschenbrenner
*Assistant Examiner*—Thomas A. Rendos
*Attorney, Agent, or Firm*—Bernard, Rothwell & Brown

[57] ABSTRACT

A product display and dispensing unit comprises a plurality of juxtaposed compartments made from body members and side panels. Keys are provided on the body members and engage complementary slots on the side panels. Each slot accommodates two keys, one key of a comaprtment located at either side of the panels. The lid comprises a plate member having a handle and an upper lip which engages dowels in the side panels.

15 Claims, 8 Drawing Sheets

PRODUCT DISPLAY AND DISPENSING UNIT

The present invention relates to improvements to product display and dispensing units.

BACKGROUND OF THE INVENTION

In retail outlets it is customary to have display and dispensing units for use in selling loose confectionery, dried fruit and nuts and various food products on a self service basis. Each unit has a number of compartments each containing a different variety of confectionery or food. The customer selects the required amount from each compartment, using a scoop or other handling device. Display and dispensing units may also be termed as merchandising units.

The prior art units are manufactured from sheets of a plastics material such as acrylic which are glued together to form the structure. Each compartment is provided with a hinged lid.

There are, however, a number of disadvantages associated with prior art units.

Firstly, as the vast majority of products sold using these units are unwrapped, it is essential that each compartment be cleaned regularly. As the compartments are glued together, however, it is not possible to clean them thoroughly, particularly the corners. Also, the hinge of the lid may corrode after a short period of time and thus provides a possible source of contamination.

A second major disadvantage associated with prior art units is that as each unit may have four or six individual compartments, if one compartment is damaged or broken, then it is usually necessary to discard the entire unit.

Thirdly, when the units are being transported or stored, they use a considerable amount of space, thus adding to transport, storage and handling costs.

A further disadvantage associated with prior art units is the waste of material. As each unit is normally two compartments wide, a plurality of units located side by side will have a number of juxtaposed side walls.

Another problem encountered in retail outlets occurs with the sale on a self-service basis of prepared salads and other foods ready for consumption in that these foods are open to contamination.

The object of the invention is to alleviate the above disadvantages.

SUMMARY OF THE INVENTION

The present invention provides a product display and dispensing unit comprising at least one compartment for loose products, each compartment comprising a body member and a pair of side panels with pairs of complementary engageable and disengageable elements for engaging and disengaging the side panels and the body member.

Advantageously, a plurality of compartments are arranged in a column and the body members of said compartments engage two side panels, one panel being located at each side of the column of compartments.

Preferably, the body members of two juxtaposed compartments engage a common side panel located between said compartments.

Conveniently, each pair of complementary engageable and disengageable elements comprises a key and a slot and a plurality of said keys are provided on each body member and the corresponding keys of any two juxtaposed body members engage a single slot in a side panel located between said body members.

According to one aspect of the invention, each compartment is provided with a lid which is freely supported at one end, whereby the lid may be pivoted about that end and/or moved into the body of the compartment to allow access thereto or may be removed for cleaning purposes.

According to a further aspect of the invention, each compartment is provided with a lid which is pivotally and removably attached to the body with closing means being provided for gradually closing the lid whereby when the lid is opened to allow access to the compartment the lid closes gradually so as to cover the product contained within the compartment.

The invention also provides a product display and dispensing in which each compartment is provided with a filling and stacking chute by means of which the compartment is stocked with product.

Also if desired, a gasket seal is provided between the edges of the body member and the side panels. A seal may also be provided between the edges of the lid and the side panels.

BRIEF DESCRIPTION OF THE DRAWINGS

The invention will hereinafter be more particularly described with reference to the accompanying drawings, which show by way of example only, five embodiments according to the invention. In the drawings.

DETAILED DESCRIPTION OF THE PREFERRED EMBODIMENTS OF THE INVENTION

Figure 1:
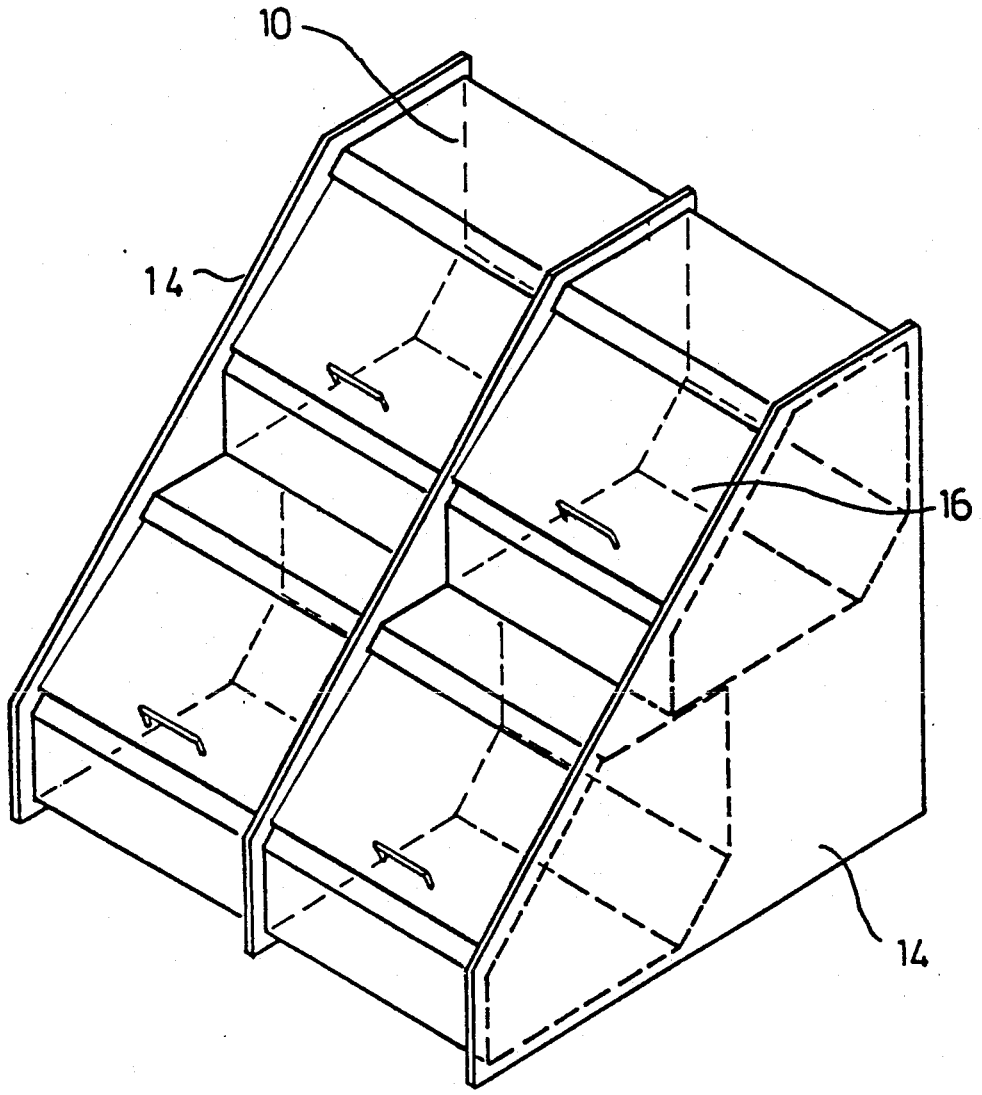
FIG. 1 is a perspective view of a first embodiment of a unit according to the invention. The unit contains four compartments, two columns of two.
Figure 2:
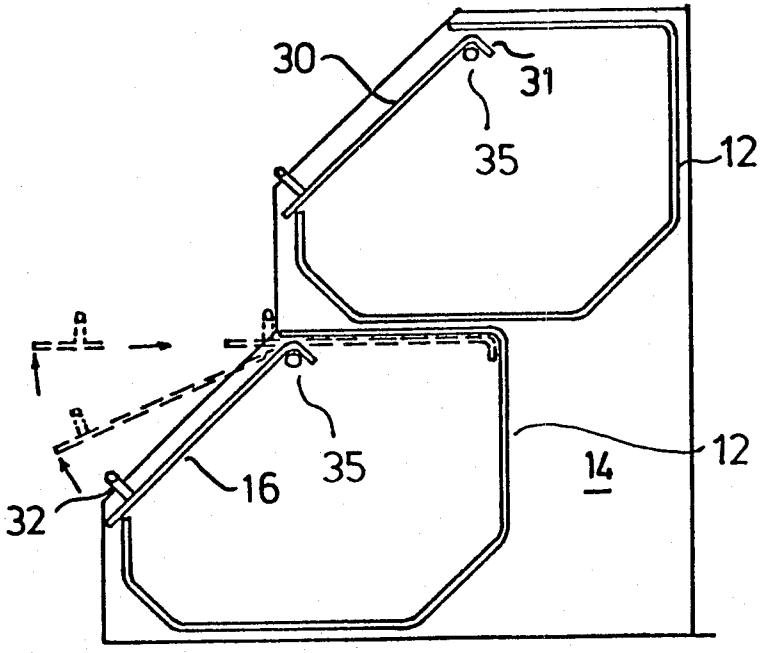
FIG. 2 is a cross-sectional side view of the unit as shown in FIG. 1.
Figure 3:
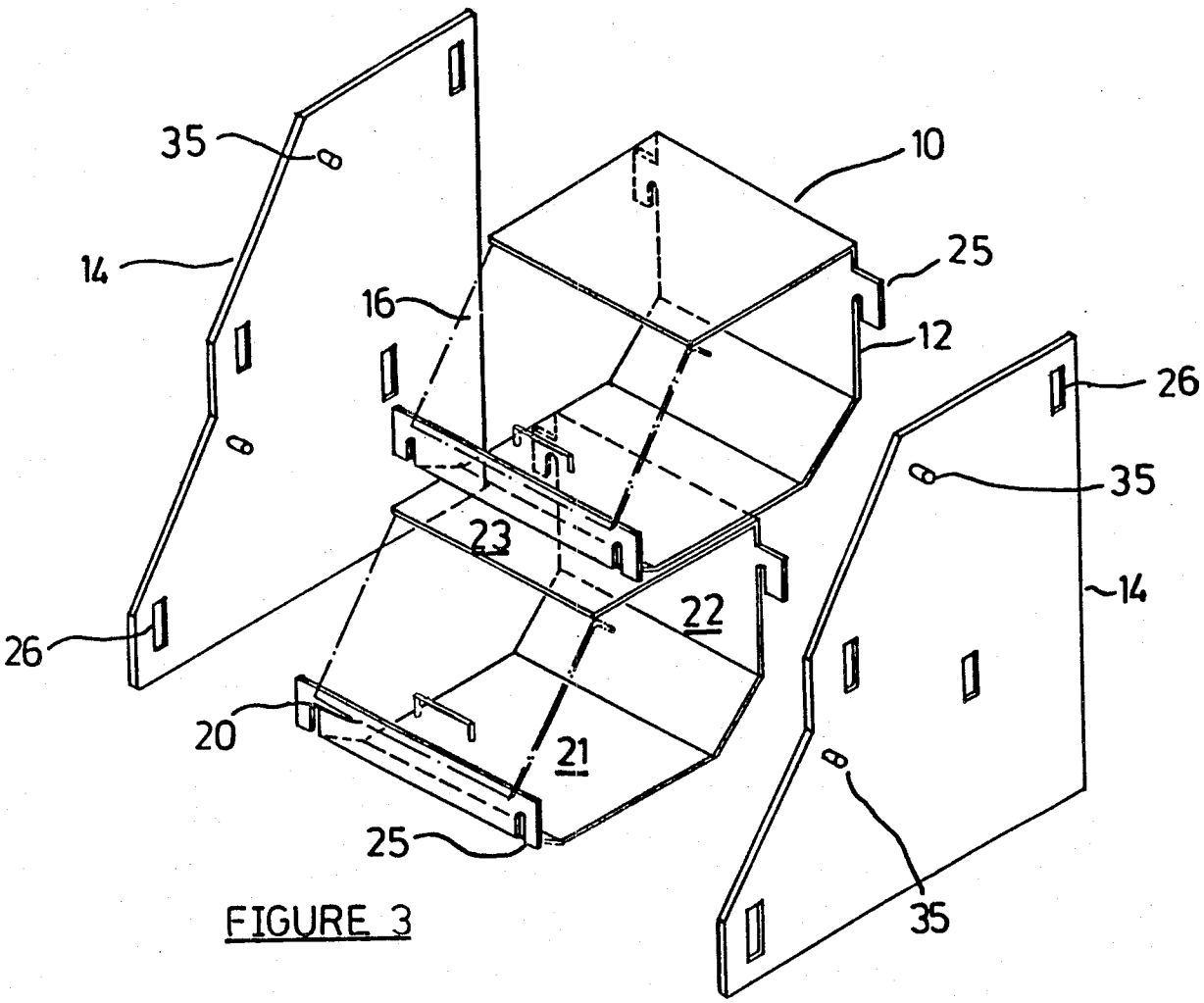
FIG. 3 is an exploded perspective view of two of the compartments of the first embodiment.

Referring to the drawings, and initially to FIGS. 1 to 3, each display and dispensing unit comprises a plurality of juxtaposed compartments 10 each of which comprises a body member 12, a portion of side panels 14 and an unhinged lid 16.

Each body member 12 is formed from a sheet of transparent acrylic plastics material and comprises a front lip 20, a base 21, a sloped and vertical rear wall 22 and a roof member 23. A pair of keys 25 is provided on the front lip 20 and the rear wall 22.

Each of the keys 25 engages a complementary slot 26 in the side panels 14 which provides side walls for the compartments 10 and the unit as a whole. Each slot 26 accommodates two keys 25, one key of a compartment 10 located at either side of a panel 14.

The lid 16 comprises a plate member 30 having an upper lip 31 and a handle 32. As best shown in FIG. 2 the upper lid 31 engages with dowels 35 in the side panels 14. The lid 16 may be pivoted about the dowels 35 until it is in a horizontal position when it is pushed into the compartment 10 underneath the roof 23 until the handle 32 contacts the front edge of the roof member 23.

The units of the invention may be arranged in any desired number of compartments high and wide to suit the space available and range of products on sale. This arrangement may be achieved by selecting the appropriate size panels 14.

For cleaning, or transport or storage purposes, the units may be readily disassembled by disengaging the keys 25 from the slots 26 and readily reassembled when required.

If part of a unit or compartment is broken then the broken part may be removed from the unit and replaced.

Figure 4:
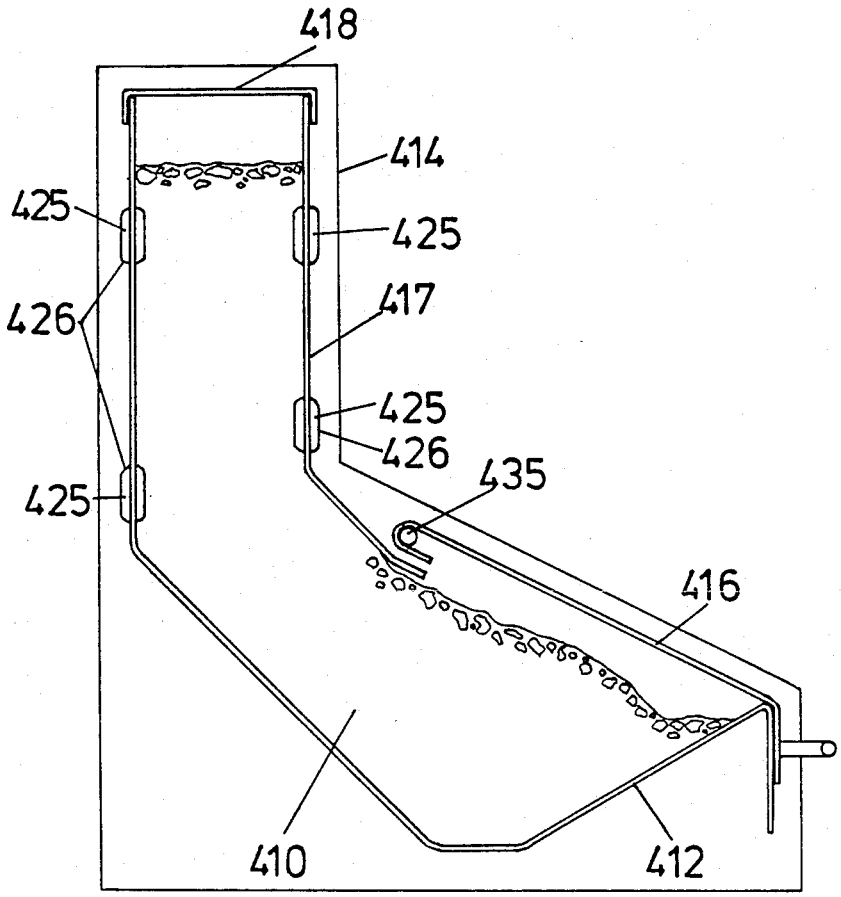
FIG. 4 a cross-sectional side view of one compartment of a second embodiment according to the invention.

The second embodiment will now be described with reference to FIG. 4. One compartment 410 of a unit is shown and it also comprises a body member 412, a side panel 414 and a lid 416. Keys 425 are provided on the body members 412 and engage complementary slots 426 in the side panels 414. The main additional feature associated with the second embodiment is the provision of a filling and stacking chute 417 which is accessed by removing cover 418. The filling of the chute 417 with product achieves two main functions. Firstly, as product is removed, the product in the chute 417 gravitates downwards thus replacing the product. Secondly, as the walls of the chute 417 are manufactured from a clear acrylic plastics material, the chute 417 provides a very effective display of the product being sold.

Figure 5:
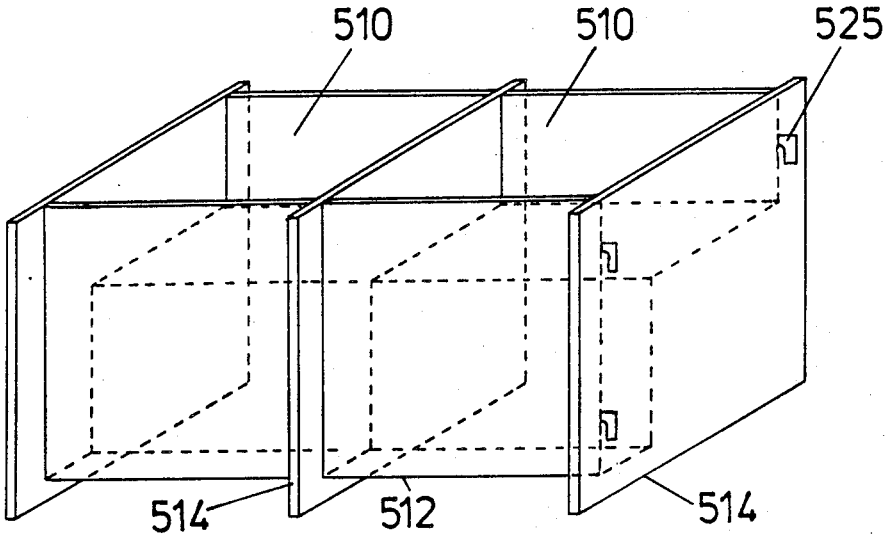
FIG. 5 is a perspective view of two compartments of a third embodiment according to the invention.
Figure 6:
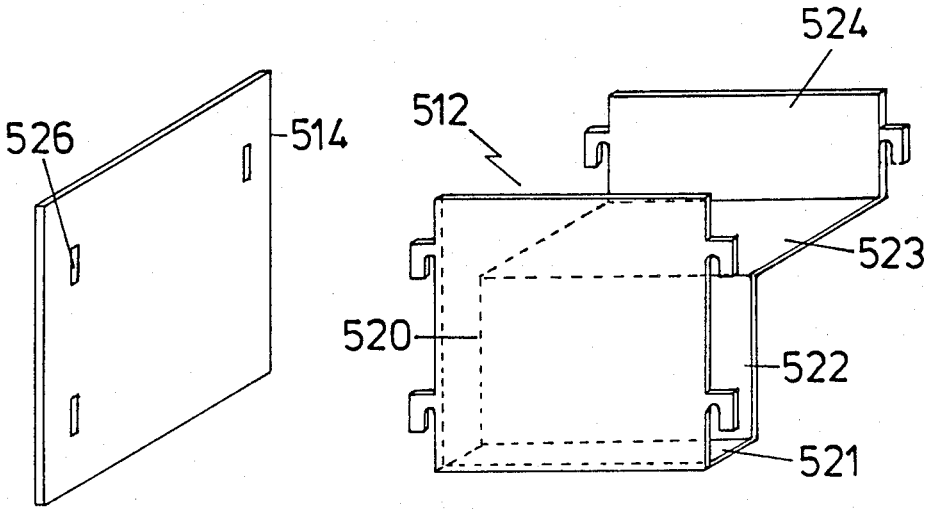
FIG. 6 is an exploded view of one of the compartments of the third embodiment.

The third embodiment of the invention will now be described with reference to FIGS. 5 and 6. A unit comprising these compartments 510 would be placed at a lower level than the units of the first and second embodiments. The display and dispensing compartments 510 function as dip bins and each unit comprises a body member 512 and side panels 514. No lid is provided and thus these compartments would be used for merchandise which is wrapped.

Each body member 512 is formed from a sheet of transparent acrylic plastics material and comprises a front wall 520, a short base 521, an inner wall 522, a main base 523 and a rear wall 524. The space between the front wall 520 and the inner wall 522 is chiefly for display of the product being sold. The main dispensing region of the compartment is that region defined between the front wall 520, the main base 523 and the rear wall 524. The body member 512 is provided with three sets of keys 525 which engage in slots 526 on the side panels 514 as in the first embodiment.

Figure 7:
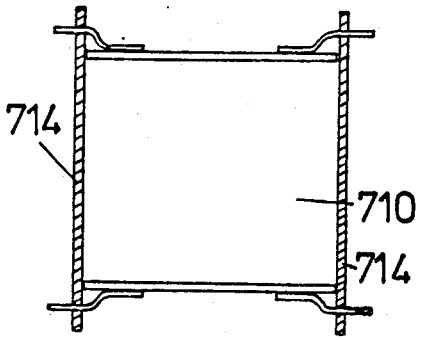
FIG. 7 is a cross sectional plan view of a compartment of a fourth embodiment according to the invention and having a body member and two side panels.
Figure 8:
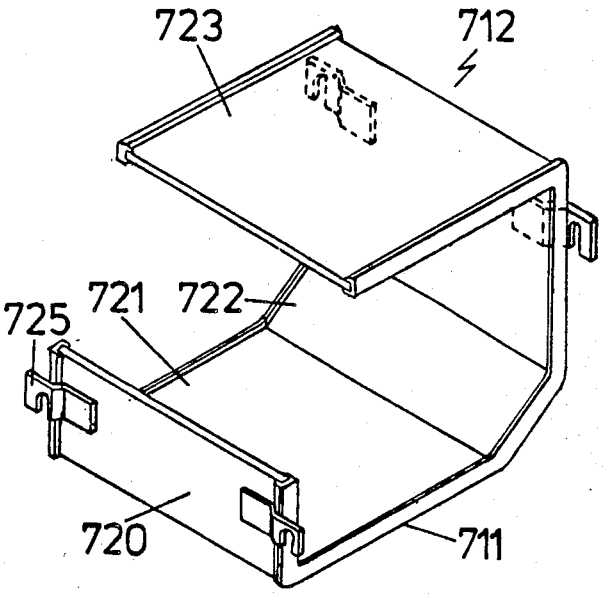
FIG. 8 is a perspective view of the body member of the fourth embodiment.
Figure 9:
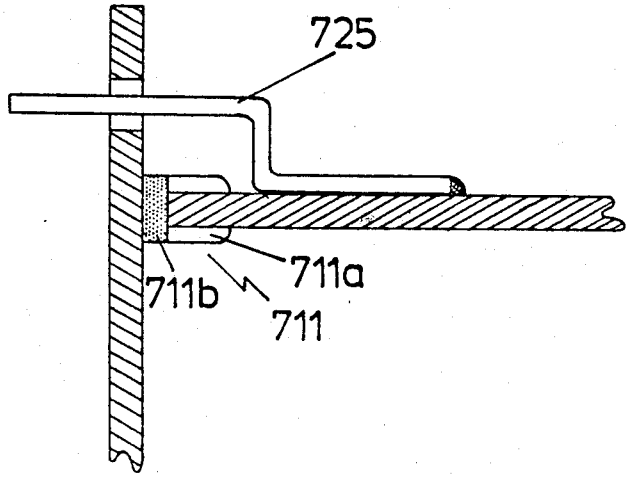
FIG. 9 is a detail view on a larger scale showing the connection between the body member and a side panel of the fourth embodiment.

FIGS. 7 to 9 illustrate the fourth embodiment. A unit of this embodiment comprises a number of compartments 710 which differ from the compartments 10 of the units of the first embodiment in that a gasket or sealing element 711 is provided between the body member 712 and engaged side panels 714.

Each body member 712 is formed from a sheet of transparent acrylic plastics material and comprises a front lip 720, a base 721, a sloped and vertical rear wall 722 and a roof 723. Along each of the side edges of the lip 720, base 721, wall 722 and roof 723 is provided a gasket 711 which in the fourth embodiment is a dual rigid/soft extruded polyvinylchloride material. The rigid part 711*a* of the gasket 711 is fitted over the edge of the body member 712 and the soft part 711*b* seals against the side panel 714. A pair of cranked keys 725 are attached to the front lip 720 and the rear wall 722. The keys 725, which are of a polycarbonate or a high impact acrylic material, are cranked to allow for the gasket 711 and are attached to the body member 712 by being surface glued and fillet welded.

A unit of the fourth embodiment can be used to accommodate fine grain material, such as various health foods.

Figure 10:
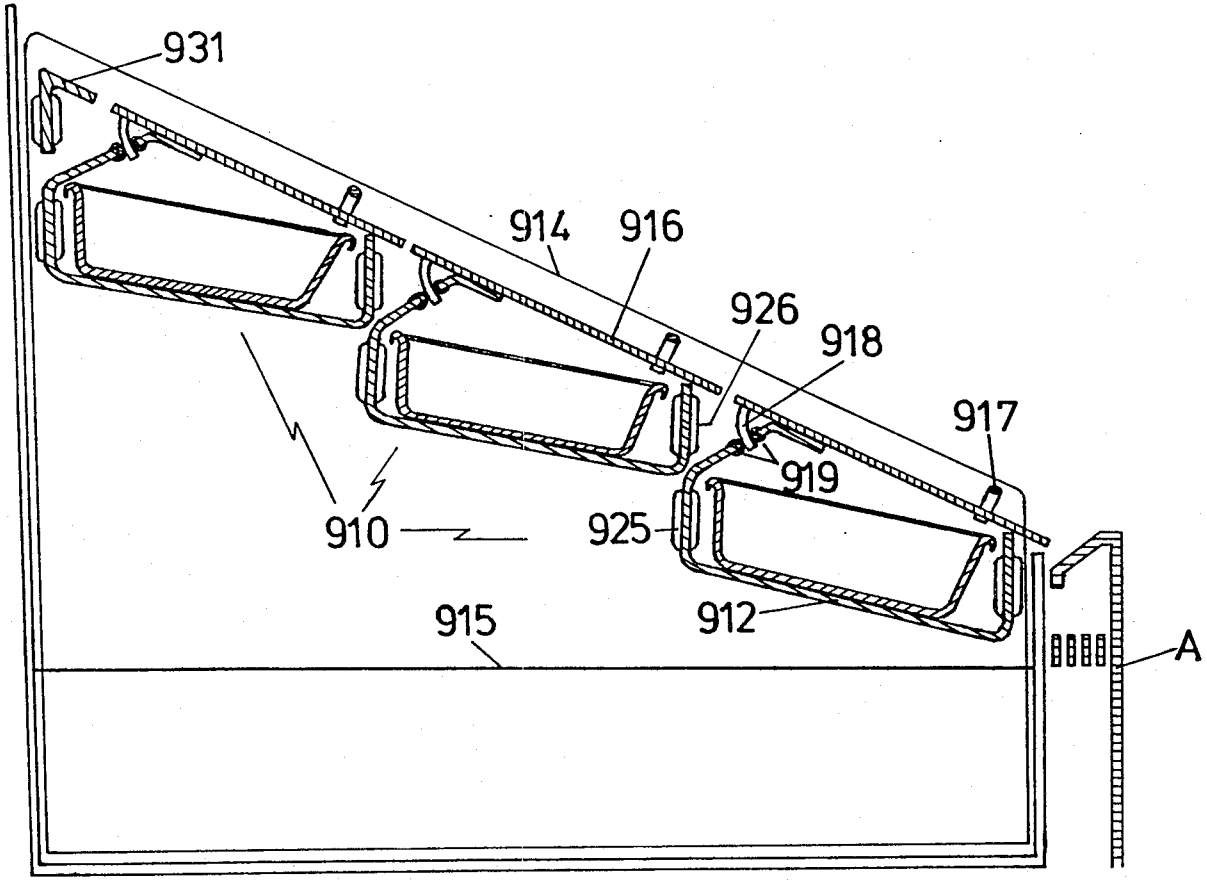
FIG. 10 is a cross-sectional side view of a unit of a fifth embodiment according to the invention and showing three compartments in side view.
Figure 11:
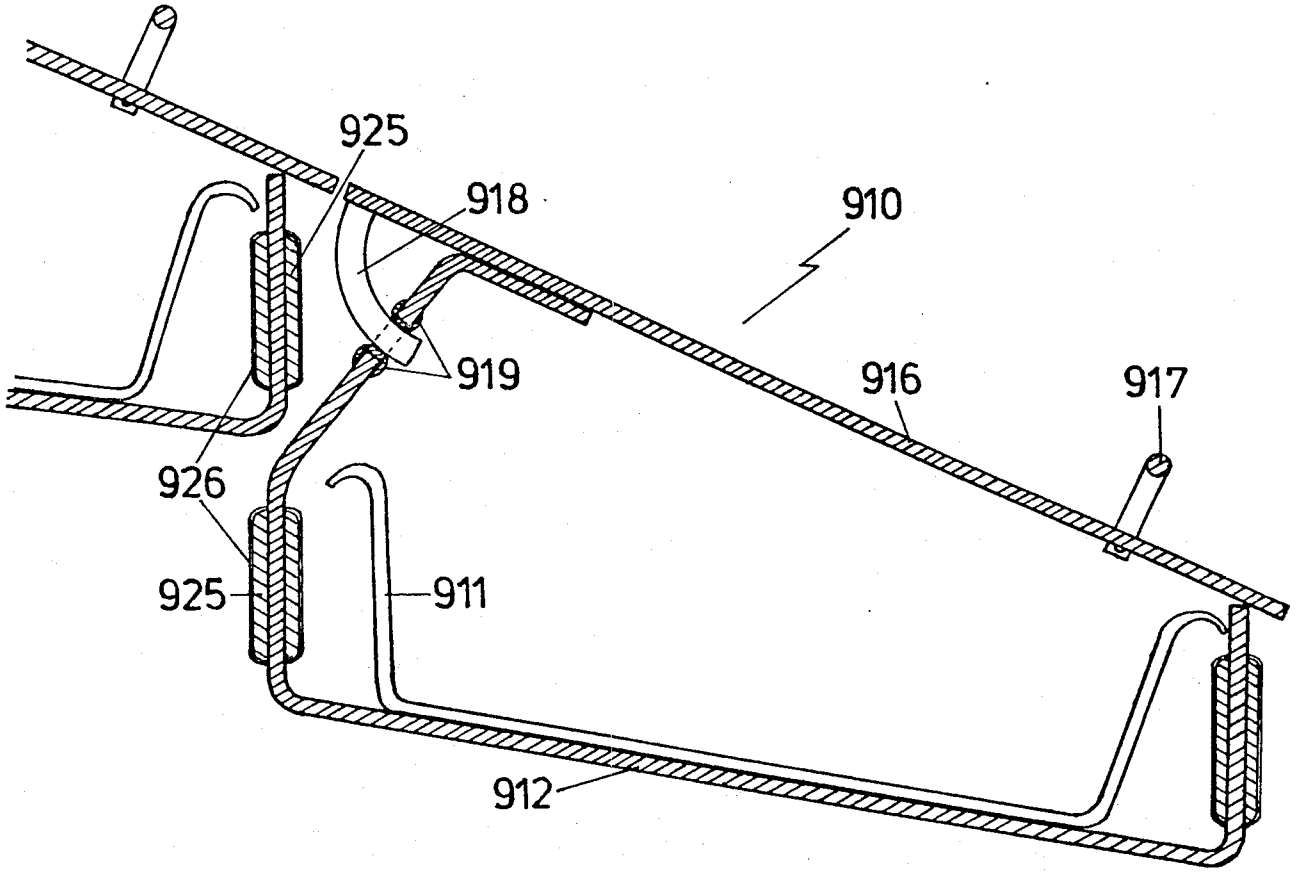
FIG. 11 is a cross-sectional side view of one compartment of the fifth embodiment on a larger scale.

The fifth embodiment of the invention is described with reference to FIGS. 10 and 11 of the drawings. The unit shown is mounted in a freezer display cabinet A and has three compartments 910. Trays 911 containing prepared food are contained within each compartment 910 and the food is removed by retail customers as required on a self-service basis.

Each compartment 910 comprises a body member 912, the body member being supported by side panels 914. Keys 925 are provided on the body members 912 and engage complementary slots 926 in its side panels 914. A base 915 is provided in the cabinet A to support the side panels 914. Each of the compartments 910 has a lid 916 which is provided with a handle 917 and two arced lugs 918. The lugs 918 engage rubber grommets 919 which allow gradual closing of the lid 916 under its own weight when it has been opened. To remove a lid 916 the lugs 918 are merely removed from the grommets 919. An end panel 931 is located adjacent the upper edge of the uppermost lid 916 so as to prevent the lugs 918 from being accidentally removed from the grommets 919 when the lid is being opened.

Using the units of the five embodiments described it is possible to produce a large combination of display and dispensing units for many types of merchandise.

I claim:

1. A product display and dispensing unit comprising at least one compartment for loose products, each compartment comprising a body member and a pair of side panels with pairs of complimentary engageable and disengageable means for fastening together the side panels and the body member, each of said pairs comprising a key fixedly attached to said body member and a slot in a side panel, said key forming an open ended notch that is complementarily engageable and disengageable with said slot, said key being fixedly attached to said body member both prior to and during engagement with said slot, said pairs of complimentary engageable and disengageable means being the only means for fastening together the side panels and the body member.

2. A product display and dispensing unit as claimed in claim 1, wherein a plurality of compartments are arranged in a column and the body members of said compartments engage two side panels, one panel located at each side of the column of compartments.

3. A product display and dispensing unit as claimed in claim 2, wherein the body members of two juxtaposed compartments engage a common side panel located between said compartments.

4. A product display and dispensing unit as claimed in claim 1, wherein each compartment is provided with a lid, which is freely supported at one end, whereby the lid may be pivoted about that end and moved into the body of the compartment to allow access thereto or may be removed for cleaning purposes.

5. A product display and dispensing unit as claimed in claim 1, in which each compartment is provided with a filling and stacking chute by means of which the compartment is stocked with product.

6. A product display and dispensing unit as claimed in claim 1, in which a seal is provided between the mating edges of the elements of the unit.

7. A product display and dispensing unit as claimed in claim 1, in which each compartment is provided with a lid which is pivotally and removably attached to the body with closing means being provided for gradually closing the lid, whereby when the lid is opened to allow access to the compartment, the lid closes gradually so as to cover the product contained within the compartment.

8. A product display and dispensing unit, as claimed in claim 1, wherein said key is fixedly attached to said body member by being formed therein.

9. A product display and dispensing unit, as claimed in claim 1, wherein said key is fixedly attached to said body member by being glued thereto.

10. A product display and dispensing unit, as claimed in claim 1, wherein said key is fixedly attached to said body member by being welded thereto.

11. A product display and dispensing unit comprising at least two side-by-side juxtaposed compartments for loose products, each compartment comprising a body member and a pair of side panels with pairs of complimentary engageable and disengageable elements for fastening together the side panels and the body member, each of said pairs comprising a key fixedly attached to said body member and a slot in a side panel, said key forming an open-ended notch that is complimentarily engageable and disengageable with said slot, said key being fixedly attached to said body member both prior to and during engagement with said slot, in which each body member comprises a plurality of said keys and in which corresponding keys of any two juxtaposed body members engage a single slot in a respective side panel located between said body members.

12. A product display and dispensing unit, as claimed in claim 11, wherein said key is fixedly attached to said body member by being formed therein.

13. A product display and dispensing unit, as claimed in claim 11, wherein said key is fixedly attached to said body member by being glued thereto.

14. A product display and dispensing unit, as claimed in claim 11, wherein said key is fixedly attached to said body member by being welded thereto.

15. A product display and dispensing unit comprising at least one compartment for loose products, each compartment comprising a body member and a pair of side panels with pairs of complimentary engageable and disengageable means for fastening together the side panels and the body member, each of said pairs comprising a key fixedly attached to said body member and a slot in a side panel, said key forming an open-ended notch that is complementarily slide-engageable and slide-disengageable with said slot, said key being fixedly attached to said body member both prior to and during engagement with said slot, said pairs of complimentary engageable and disengageable means being the only means for fastening together the side panels and the body member.

* * * * *

UNITED STATES PATENT AND TRADEMARK OFFICE

CERTIFICATE OF CORRECTION

PATENT NO. : 4,874,210

DATED : October 17, 1989

INVENTOR(S) : FRANCIS A. CARROLL

It is certified that error appears in the above-identified patent and that said Letters Patent is hereby corrected as shown below:

Front Page, Col. 2, line 18, "of 1911" should be --11/1911--.

Signed and Sealed this

Twenty-second Day of January, 1991

*Attest:*

HARRY F. MANBECK, JR.

*Attesting Officer*

*Commissioner of Patents and Trademarks*